United States Patent [19]

Bajorek et al.

[11] 4,035,978

[45] July 19, 1977

[54] TUBULAR SPINDLE COVER

[75] Inventors: Jay E. Bajorek, Wadsworth; Albert L. Newman, Cleveland Heights, both of Ohio

[73] Assignee: Questor Corporation, Toledo, Ohio

[21] Appl. No.: 687,319

[22] Filed: May 17, 1976

[51] Int. Cl.[2] ..... E04C 3/30; E04C 3/34

[52] U.S. Cl. ..... 52/727; 52/731; 256/65; 256/21

[58] Field of Search ..... 52/309, 731, 727, 311, 52/728, 585, 725; 256/21, 22, 24, 59, 65

[56] References Cited

U.S. PATENT DOCUMENTS

| | | | |
|---|---|---|---|
| 1,947,388 | 2/1934 | Frey | 52/728 |
| 2,236,926 | 4/1941 | Surface | 52/585 |
| 2,808,233 | 10/1957 | Spescha | 256/22 |
| 3,113,760 | 12/1963 | Huret et al. | 256/21 |
| 3,170,201 | 2/1965 | Nofziger | 52/731 |
| 3,200,554 | 8/1965 | Goodman et al. | 52/727 |
| 3,438,164 | 4/1969 | Duepree | 52/585 |
| 3,472,489 | 10/1969 | Baylin | 256/22 |
| 3,485,006 | 12/1969 | De Rozario | 256/65 |
| 3,498,589 | 3/1970 | Murdock | 256/21 |
| 3,804,374 | 4/1974 | Thom | 256/59 |

*Primary Examiner*—Price C. Faw, Jr.
*Assistant Examiner*—Robert C. Farber
*Attorney, Agent, or Firm*—Harry O. Ernsberger

[57] ABSTRACT

The disclosure embraces a tubular article or cover adapted to enclose a bar, spindle or baluster, the article or cover comprising longitudinal mating hollow sections provided with projections and recesses, the mating sections, in assembly, enclosing a bar, spindle or baluster, the projections being received in the recesses, the dimensions of the projections and recesses providing interengagement effective to retain the sections together, the sections having interior configurations engageable with a bar, spindle or baluster to resist movement of the tubular article or cover relative to the bar, spindle or baluster.

9 Claims, 12 Drawing Figures

TUBULAR SPINDLE COVER

The invention relates to a tubular article, such as a tubular cover construction, for enclosing a bar, spindle or baluster, comprising hollow mating sections which in mating relation are held together in assembly by interlocking engagement of projections and recesses embodied in the sections.

Architectural railing and spindle or baluster structures found in most residential and commercial railing installations are usually fashioned with spindles or balusters as bars, rods or like members made of metal such as wrough iron, steel or the like and are utilized in environments where the spindles or balusters are exposed to weather conditions or in environments where the spindles or balusters may be scratched or damaged.

Spindles or balusters usually have a decorative finish such as by applying paint or other coating. The decorative surfaces in use may be easily scratched or worn by physical contact and, where the spindles or balusters are subjected to weather conditions, the surfaces may be deteriorated, marred or imparied by oxidation or chemical action, thus detracting from the desired aesthethic or decorative effect.

The invention embraces the provision of a tubular article, such as a cover, sheath, sleeve or jacket fashioned of mating hollow sections for covering or enclosing a bar, spindle or baluster wherein the mating sections are fashioned with interengageable projections and recesses for retaining or locking the mating sections of the tubular article or cover in assembled relation.

An object of the invention is the provision of a cover, sheath, jacket or enclosure for a bar, spindle or baluster comprising mating hollow sections adapted to enclose bars, spindles or balusters of various cross sectional configurations, the sections having interior regions or portions engageable with bars, spindles or balusters for resisting or stabilizing the mating sections against movement relative to the bars, spindles or balusters enclosed by the mating sections.

Another object of the invention is the provision of a cover, sleeve or jacket for enclosing a bar, spindle or baluster comprising mating hollow sections formed of resinous or plastic material or metal, such as aluminum, the sections being fashioned with interengaging means for retaining the sections in assembled relation, the sections having lengthwise-space interior distortable or crushable portions for engagement with a bar, spindle or baluster enclosed within the sections.

Another object of the invention resides in a cover, sleeve or jacket construction for enclosing a bar, spindle or abluster comprising substantially identical mating hollow sections provided with interengageable configurations which, when interengaged in assembly, effectively lock or frictionally hold or retain the sections in assembled relation.

Another object of the invention is the provision of a tubular article, such as a cover, sleeve or jacket fashioned of mating hollow sections, the sections being fashioned with interengageable means of a character providing sufficient friction for holding or retaining the mating sections in assembled relation, the interior of the sections having portions or beads adapted to be distorted by engagement with a bar, spindle or baluster during assembly of the mating sections to resist relative rotation or movement of the assembled sections with respect to the bar, spindle or baluster enclosed by sections.

Further objects and advantages are within the scope of this invention such as relate to the arrangement, operation and function of the related elements of the structure, to various details of construction and to combinations of parts, elements per se, and to economics of manufacture and numerous other features as will be apparent from a consideration of the specification and drawing of a form of the invention, which may be preferred, in which.

Figures 1, 2, 3, 4, 5, 6, 7, 8, 9, 10, 11, 12:
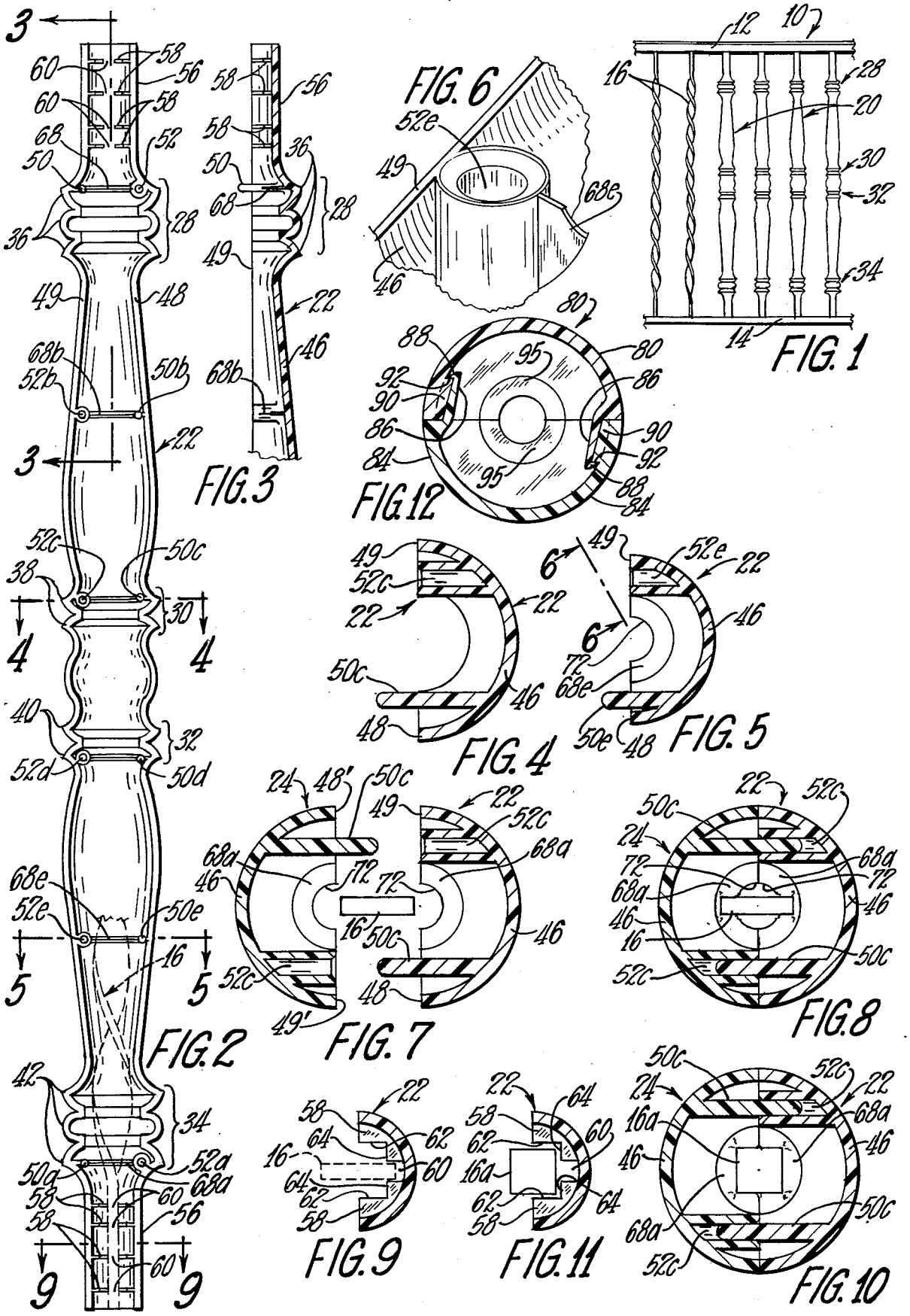
FIG. 1 is an elevational view of a portion of a railing and spindle construction illustrating uncovered spindles and spindle covers of the invention.
FIG. 2 is a front elevational view illustrating one of two substantially identical mating sections of the spindle cover construction of the invention.
FIG. 3 is a sectional view of a portion of the spindle cover section shown in FIG. 2, the view being taken substantially on the line 3-3 of FIG. 2.
FIG. 4 is an enlarged sectional view through the section shown in FIG. 2, the view being taken substantially on the line 4—4 of FIG. 2.
FIG. 5 is an enlarged sectional view taken substantially on the line 5—5 of FIG. 2.
FIG. 6 is a fragmentary enlarged view of a portion of the construction shown in FIG. 5, the view being taken on the line 6—6 of FIG. 5.
FIG. 7 is a sectional view through the mating sections illustrated in a position to be assembled to enclose a bar or spindle of flat or rectangular cross section.
FIG. 8 is a sectional view similar to FIG. 7 illustrating the sections in assembled mating relation enclosing a bar or spindle of flat or rectangular cross section.
FIG. 9 is an enlarged sectional view taken substantially on the line 9—9 of FIG. 2, the section being shown in association with a bar or spindle of flat or rectangular cross section.
FIG. 10 is an enlarged sectional view similar to FIG. 8 showing the cover sections in mating relation enclosing a bar or spindle of square cross section.
FIG. 11 is an enlarged sectional view similar to FIG. 9, the section being shown in association with a bar or spindle of square cross section.
FIG. 12 is a view similar to FIG. 8 illustrating a modified arrangement for securing the mating sections in assembled relation.

The bar, spindle or baluster cover construction illustrated in the drawings with the mating sections in assembled relation is of hollow cross section of circular contour having groups of convolutions to provide an attractive appearance, but it is to be understood that the tubular article or cover construction may be of a different cross sectional configuration if desired.

Referring to the drawings and initially to FIG. 1, there is shown a portion of a railing and spindle or baluster construction 10 with certain of the bars, spindles or balusters enclosed, covered or jacketed by the cover construction of the invention. The construction shown in FIG. 1 includes an upper railing 12 and a lower railing 14 with vertically disposed bars, spindles or balusters 16 joined to the railings.

This arrangement of railings and bars or spindles is of conventional construction, the railings usually being of metal such as wrought iron or steel. The bars or spindles 16 are usually fashioned of wrought iron or steel and, as illustrated in FIG. 1, the spindles are of flat or rectangular cross section of lengthwise spiral configuration, but they may be of square or polygonal cross sections. FIG. 1 illustrates bar or spindle cover construction 20 of the invention enclosing spindles of the character illustrated at 16.

The cover construction 20 of the invention comprises two substantially identical mating hollow sections 22 and 24, an elevational view section 22 being illustrated in FIG. 2. The hollow sections 22 and 24 in assembled relation as shown in FIGS. 1, 8 and 10 provide a tubular article, cover, sheath or sleeve 20 adapted to enclose a bar, spindle or baluster such as shown at 16 in FIG. 1.

The mating cover sections 22 and 24 are preferably fashioned of moldable materials such as resinous or plastic composition or they may be of metal such as aluminum. Several resinous or plastic compositions may be used such as acrylonitrile-butacdiene-styrene, polyvinyl chloride, talc-filled polypropylene or other suitable material. As illustrated in FIG. 1, the mating sections 22 and 24 in assembly on a bar or spindle provide a tubular article or hollow cover of circular configuration which preferably include groups of convolutions providing an attractive design or appearance.

As illustrated in FIGS. 1 and 2, each of the mating sections is fashioned with groups 28, 30, 32 and 34 of semiconvolutions. Group 28 includes convolutions 36, group 30 includes convolutions 38, group 32 includes convolutions 40 and group 34 includes convolutions 42. The mating sections 22 and 24 are illustrated as fashioned of plastic or resinous material and have comparatively thin walls 46 of substantially uniform thickness throughout the lengths of the sections.

Each of the sections 22 and 24 has marginal regions or edges which mate in assembly and the junctures are visible only as very fine lines. The section 22 is provided with marginal edge regions 48 and 49 and the section 24 is fashioned with marginal edges 48' and 49' as particularly shown in FIG. 7. The sections are of hollow or semitubular configuration to enclose bars, spindles or balusters of various sizes and cross sectional configurations. The sections are provided with interior contours adapted to accommodate bars or spindles of various cross sectional shapes and sizes as hereinafter described.

The sections are provided with interengaging configurations or means for securing or retaining the sections in assembly about a bar or spindle. In the embodiments illustrated, the sections include interengageable projections and recesses effective to secure the sections in mated assembly. In the first illustrated embodiment, the projections are cylindrically shaped pins molded integrally with the sections. The recesses in the sections in the first embodiment are in the form of cylindrical holes or openings.

The pins or cylindrical projections are of a diameter preferably the same as the diameter of the openings or holes which receive the pins. It has been found that by making the diameters of the projections and the holes or openings of the same dimension, the pins are snugly received in the holes or openings under manual pressure exerted by a person in installing the sleeves or cover sections about a spindle.

The pins and holes in the sections are arranged whereby the pins of one section register with the holes in the other section when the sections are in mating relation. The friction between the pins and the surfaces of the holes is sufficient to frictionally secure and lock the pins in the holes and thus maintain or hold the sections in assembled mating relation as shown in FIG. 8.

With particular reference to FIG. 2, the pins or projections 50 and **50*a* adjacent each end region of the section are at the left marginal edge. The openings or recesses 52 and 52*a* are adjacent the right-hand marginal edge of the section and in transverse alignment with the pins 50 and 50*a*. The pins 50*b*, 50*c*, 50*d* 50*e* are disposed in lengthwise-spaced relation adjacent the right-hand marginal edge or region of the section as shonw in FIG. 2. The holes or recesses 52*b*, 52*c*, 52*d* and 52*e* are arranged along the left-hand marginal edge or region of the section in respective transverse alignment with the pins 50*b*, 50*c*, 50*d* and 50*e*.** Thus when one section is assembled with the other identical section, the pins of the sections are received in the holes or recesses in the sections.

FIG. 7 illustrates the sections 22 and 24 in position to be moved toward each other to enclose a bar, spindle or baluster. FIG. 8 illustrates the sections 22 and 24 in assembled mating relation enclosing a bar, spindle or baluster. While it is found desirable to have some of the projections along each marginal edge as illustrated in section 22 in FIG. 2, it is to be understood that a different orientation of projections and recesses may be employed for holding the sections in assembled relation. For example, all of the recesses or holes may be along one marginal edge and all of the projections along the other marginal edge.

As shown in FIG. 2, the section 22, as well as the section 24, are fashioned with semicylindrical end portions 56 in which are integrally formed transversely-disposed lengthwise-spaced pairs of ribs or protrusions 58, there being four pairs of ribs in each end region 56. The ribs 58 are also illustrated in FIGS. 9 and 11. The pairs of ribs 58 are separated providing spaces 60. The spaces 60 are for the purpose of accommodating edge regions of bars or spindles of rectangular or flat cross section.

The pairs of ribs 58 are configurated with edges 62 and 64 which, when the sections are in mating relation, define a substantially square space to accommodate a bar or spindle of square cross section, as shown in FIG. 11. Such configuration is also adapted to accommodate bars or spindles of polygonally shaped cross section. It is to be understood that the space 60 between the pairs of ribs 58 accommodate flat spindles of lesser dimension than the spaces 60, and the edges 62 and 64 accommodate spindles of square cross section of lesser dimension than the square spaced defined by the edges 62 and 64.

The invention is inclusive of a means, arrangement or configuration formed interiorly on the sections facilitating engagement of the cover sections with a spindle irrespective of the cross sectional shape and size of the bar or spindle to be enclosed by the cover sections. Referring to FIG. 2 there is integrally formed interiorly of the sections inwardly extending portions, beads or thin webs of material of the sections disposed in positions to be distorted or crushed when engaged with a bar or spindle being enclosed by the sections.

Referring to FIGS. 1, 3 and 5, beads or webs **68, 68*a*, 68*b* and 68*e* are disposed adjacent the projections 50, 50*a*, 50*b* and 50*e* and extend transversely of the longitudinal axis of the sections. Each of the webs is preferably of the same configuration, being the configuration shown at 68*e* in FIG. 5. Each crush bead or web is fashioned with a seimcircular edge 72, this edge of a web engaging a bar or spindle 16** during assembly of the sections therewith.

The beads or webs, when engaged with a bar or spindle, are crushed or distorted by the spindle during assembly of the sections, the web 68*a* being shown in crushed or distorted condition by reason of its being engaged by the spindle. The beads or webs are preferably of a thickness of about twenty-five thousandths of an inch but may be of greater or lesser thickness.

FIG. 10 illustrates the distortion of the webs, such as the web 68*a*, when the mating sections are enclosed about a spindle or bar 16*a* of square configuration in cross section. FIG. 6 illustrates a portion of the web or crush bead 68*e* at the region of its juncture with the portion of the section containing the opening or recess 52*e*.

The crushing or distortion of the beads or webs 68, 68*a*, 68*b* and 68*e* when they engage the bar or spindle stabilizes the cover sections on the bar or spindle so that there is no relative movement or rotation of the sections with respect to the enclosed bar or spindle. This is an important feature in that in installations exposed to weather conditions, the wind will not cause the sections to rattle or move relative to the bar or spindle. Furthermore, physical engagement with a cover will not cause it to rattle.

FIG. 10 illustrates the distortion of a crush bead or web 68*a* when the sections are assembled enclosing a bar or spindle 16*a* of rectangular cross section. FIG. 11 illustrates the relation of the ribs 58 with respect to a bar or spindle 16*a* of square cross section wherein the bar or spindle is of lesser dimension than the distance between the edges 62 and 64 when the sections are in mating relation.

As previously mentioned herein the pins or projections and the recesses or openings accommodating the projections are preferably of identical diameters and it is found that when the mating sections are manually squeezed toward each other to enclose a bar or spindle, there is ample friction between the surfaces of the pins and the openings or recesses to hold or lock the sections together so that they cannot be readily separated or dislodged.

FIG. 12 is a sectional view illustrating an enclosure structure 80 comprising substantially identical mating sections 82 and 84 which are generally of the same exterior and interior contour and configuration as the sections 22 and 24 except for the modification of means or arrangement for holding the sections in mating or assembled relation enclosing a bar or spindle. The sections 82 and 84 are each provided with a plurality of pairs or sets of lengthwise-spaced projections or projecting portions 86 and pairs of recesses 92 for holding or locking the sections in assembled relation.

Each of the projections or projecting portions 86 is provided with a ridge, detent or tooth 88. Each of the sections 82 and 84 is provided with inwardly extending portions 90 transversely disposed opposite the projections, each portion 90 forming with a section wall a recess 92 adapted to receive a ridge, detent or tooth 88. While FIG. 12 illustrates one pair or set of projections 86, ridges 88 and recesses 92, the successive lenghtwise-spaced pairs or sets of projections, ridges and recesses are alternately on opposite sections in order to provide interlocking engagment of the pairs or sets of ridges and recesses to hold the mating sections together.

In assembly, in moving the sections 82 and 84 into engaged mating relation, the projections 86 are flexed inwardly by engagement with the inwardly extending portions or projections 90 whereby each of the ridges or detents 88 is snapped into a recess 92, thus holding or locking the sections 82 and 84 in mating relation. It is desirable that each of the projections 86 and its adjacent recess 92 be of comparatively short lengths, for example, one-fourth inch to one-half inch in length.

Furthermore, the interlocking projections and recesses may be less than one-fourth of an inch or greater than a half inch in length if desired. The projections 86 fashioned integrally with the cover sections 82 and 84 are comparatively thin so as to enable flexing of the projections 86 to facilitate locking of the ridges or detents 88 in the recesses 92.

The sections 82 and 84 are formed interiorly with lengthwise-spaced beads or webs 95 adapted to be engaged with a spindle and distorted or crushed during assembly of the mating sections enclosing a spindle. The distortable or crushable beads or webs 95 may be of the same character as the distortable or crushable beads or webs embodied in the cover sections 22 and 24.

It is apparent that, within the scope of the invention, modifications and different arrangements may be made other than as herein disclosed, and the present disclosure is illustrative merely, the invention comprehending all variations thereof.

We claim:

1. A tubular article for enclosing a bar comprising, in combination, a pair of elongated mating hollow sections having edge configurations adapted for mating engagement in assembled relation, interengageable means on said sections for retaining the sections in mating assembled relation, said means including projections and recesses to receive the projections, said projections and recesses being dimensioned whereby the projections are snugly received in the recesses with sufficient friction to hold the sections in assembled mating relation, said sections having lengthwise-spaced portions adapted to be crushed by the bar during assembly of the sections for resisting movement of said sections relative to the bar enclosed by the sections.

2. The combination according to claim 1 wherein the mating sections are of resinous material.

3. The combination according to claim 1 wherein the mating sections are of resinous material selected from the group comprising acrylonitrile-butadiene-sytrene, polyvinyl chloride and talc-filled polypropylene.

4. A tubular article for enclosing a bar comprising, in combination, a pair of elongated mating hollow sections of resinous material having longitudinal edge configurations adapted for mating engagement in assembled relation, said sections having interengageable projections and recesses for retaining the sections in assembled relation enclosing a bar, and means comprising comparatively thin bead portions interiorly of the sections adapted to be crushed by the bar for resisting movement of said sections relative to the bar enclosed by the sections.

5. A tubular article for enclosing a bar comprising, in combination, a pair of elongated mating hollow sections having longitudinal edge configurations adapted for mating engagement in assembled relation, said sections having interengageable projections and recesses for retaining the sections in assembled relation enclosing a bar, at least one of said sections having lengthwise-spaced transversely extending bead portions adapted to be crushed upon engagement with a bar for resisting movement of said sections relative to the bar enclosed by the sections.

6. A tubular article for enclosing a bar, in combination, a pair of elongated mating hollow sections having longitudinal edge configurations adapted for mating engagement in assembled relation, interengageable means on said sections for retaining the sections in mating assembled relation, said means including pins and openings to receive the pins, said pins and openings being dimensioned whereby the pins are snugly received in the openings with sufficient friction to hold the sections in assembled mating relation.

7. The combination according to claim 6 including bead portions in said sections adjacent pins and openings adapted to be crushed by the bar during assembly of the sections enclosing the bar for resisting rotative movement of the sections relative to the bar.

8. A tubular article for enclosing a bar, in combination, a pair of elongated mating hollow sections having longitudinal edge configurations adapted for mating engagement in assembled relation, said sections having interengageable projections and recesses for retaining the sections in mating relation, said projections being of cylindrical shape, the said recesses being cylindrical openings to receive the pins, the pins of one section mating with the cylindrical openings in the other section, said pins and openings being dimensioned whereby the pins snugly fit in the openings with sufficient friction to hold the sections in assembled mating relation.

9. A tubular article for enclosing a spindle comprising, in combination, a pair of elongated mating hollow sections having longitudinal edge configurations adapted for mating engagement in assembled relation, means on said sections adapted for interengagement for retaining the sections in assembled relation, each of said sections having lengthwise-spaced transversely-extending beads, said beads being comparatively thin whereby they are adapted to be crushed by the spindle in assembling the mating sections for resisting movement of said sections relative to the spindle.

* * * * *